United States Patent [19]

Ajuria

[11] 4,062,722

[45] Dec. 13, 1977

[54] DEVICE FOR TREATING DEFORMABLE PARTICLES WITH THE COUNTERFLOWING LIQUIDS

[76] Inventor: Carlos Ibañez Ajuria, Velazquez, 73, Madrid, Spain

[21] Appl. No.: 721,106

[22] Filed: Sept. 7, 1976

Related U.S. Application Data

[63] Continuation-in-part of Ser. No. 541,236, Jan. 15, 1975, abandoned.

[30] Foreign Application Priority Data

Jan. 18, 1974 Spain ..... 422217

[51] Int. Cl.[2] ..... D21C 7/12; D21C 9/10; D21C 9/02

[52] U.S. Cl. ..... 162/234; 68/181 R; 162/60; 162/237; 162/238; 162/242; 162/243; 162/250

[58] Field of Search ..... 162/17, 20, 26, 19, 162/233, 60, 234, 242, 237, 238, DIG. 10, 243, 248, 250; 68/181 R; 8/156

[56] References Cited

U.S. PATENT DOCUMENTS

| | | | |
|---|---|---|---|
| 2,765,645 | 10/1956 | Hannunkari et al. | 68/181 R |
| 2,916,346 | 12/1959 | Jalkanen | 8/156 |
| 3,398,412 | 8/1968 | Aremaa | 8/156 |
| 3,599,448 | 8/1971 | Green | 68/181 R |
| 3,660,225 | 5/1972 | Verreyne et al. | 162/17 |
| 3,754,417 | 8/1973 | Jamieson | 68/181 R |
| 3,807,202 | 4/1974 | Gunkel | 68/181 R |
| 3,843,468 | 10/1974 | Laakso | 162/52 X |

FOREIGN PATENT DOCUMENTS 422,417 3/1976 Spain.

OTHER PUBLICATIONS

Rydholm, "Pulping Processes", Interscience Publishers, New York, 1965.

*Primary Examiner*—S. Leon Bashore
*Assistant Examiner*—Steve Alvo

[57] ABSTRACT

A device for the counterflow treatment of fibrous deformable particles with liquid in stages in a tower. In the tower the particles and liquid flow downward by small movements and the liquid flows upwardly. Each of these successive two movements constitute one stage. The ascent of liquid alone, or filtration in each stage, is produced by introductions of water with adequate pressure through the bottom of the tower. The descent of the mass of particles and liquid or mass movement in each stage, is produced by rapid removal of mass from the lower part of the tower. During filtration periods, the particles suffer only small relative displacements among them, because the upper layer of the particles is retained by a screen, that only permits the flow of liquors; in addition, successive grids extending from the proximity of the screen to the proximity of the bottom of the tower, offer resistance to movement of the particles. In order to produce both adequate mass-movement and filtration, it is necessary that the velocity of liquid in both directions be correctly determined. The velocity of descent must be sufficient to provoke the dragging, and shearing against the grids of the mass of particles. The velocity of ascent must be slow enough to produce only small local differences in particle concentration, with slight increases in concentration below the screen and the lower edges of the grids. The water introduced at the bottom of the tower, the removal of mass at the bottom of the tower, as well as the introduction of the particles are automatically controlled.

5 Claims, 18 Drawing Figures

FIG. 2
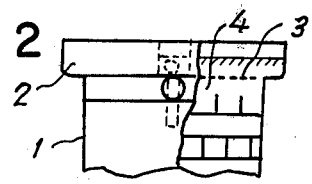
FIG. 3
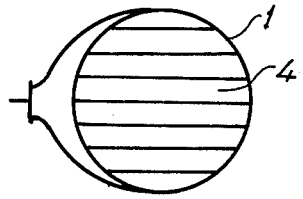
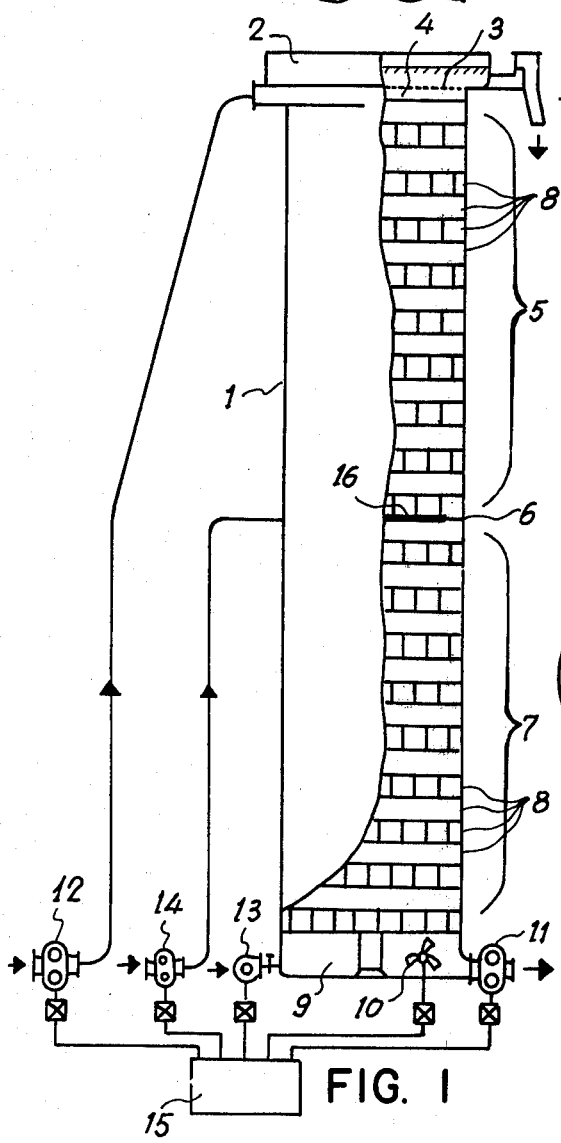
FIG. 1
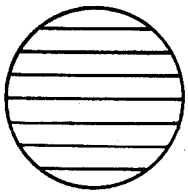
FIG. 4
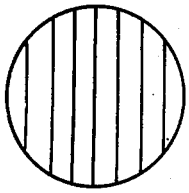
FIG. 5
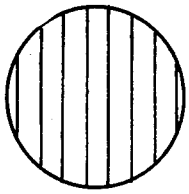
FIG. 7
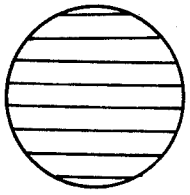
FIG. 6
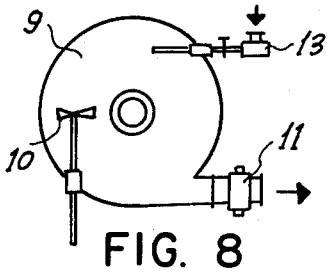
FIG. 8

FIG. 17
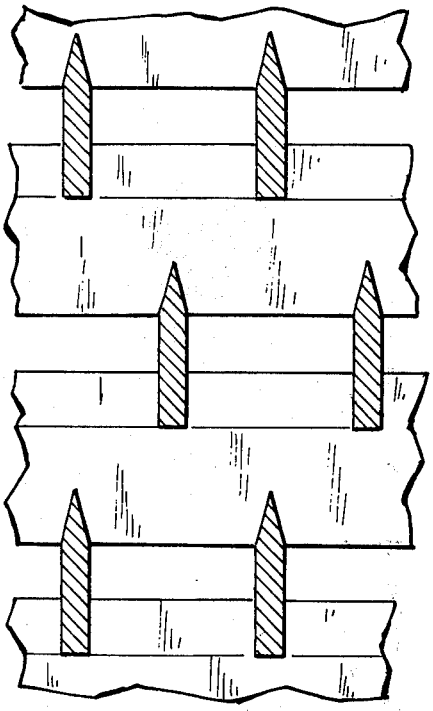
FIG. 18
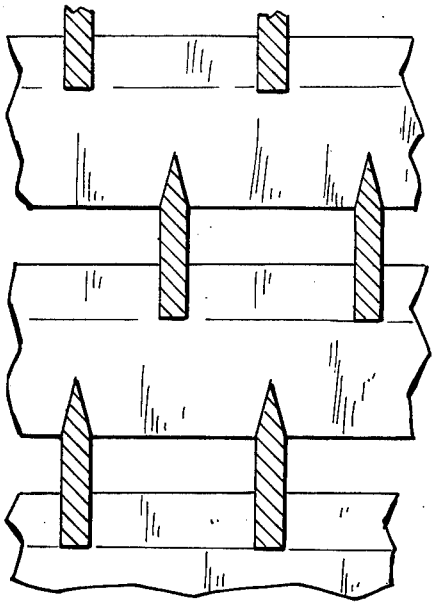
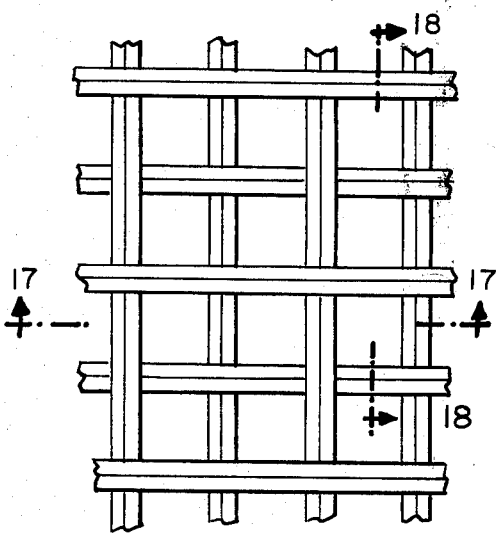
FIG. 16

DEVICE FOR TREATING DEFORMABLE PARTICLES WITH THE COUNTERFLOWING LIQUIDS

CROSS-REFERENCE TO RELATED APPLICATION

This application is a Continuation-In-Part of U.S. Pat. application Ser. No. 541,236 filed Jan. 15, 1975 and now abandoned.

BACKGROUND OF THE INVENTION

This invention includes a method and a device to carry out treatment by stages of fibrous and deformable materials of small size with a liquor of treatment. The device essentially consists of a vertical tower through which the liquid and solid phases are made to circulate in opposite directions by means of alternative small downward movement of liquid and solid particles and small upward movements, with a longer run, of liquid alone. There can be three parts differentiated inside the tower, the upper one is a small compartment with a screen in its upper side to permit the escape of the treatment liquor and with a lateral entrance for the mass of particles; the middle one is filled with a series of contiguous grids; and the lower part is a small compartment designed to alternatively extract the treated mass of particles and introduce the washing liquor, the amount of both flows effecting the movements at each stage. There are entrances at intermediate heights to permit the access of liquid reagents in the case of chemical treatments, and vapor inlets or heating systems may be accommodated to heat the materials during treatment. Introduction and removal of the mass of particles and liquid, and introduction of water and liquid reagents, are effected by exterior means working intermittently, the ones producing the introduction and removal of the mass working during the time of downward mass movement in each stage and the ones causing the liquid inflows working during the time of ascending liquid filtration in each stage. With these movements the treatment proceeds with periods of no relative movement between particles and liquid, similar to a confluent treatment, alternating with periods of particle-liquid relative movement of a longer duration, and similar to a counterflow treatment.

The unique feature of this invention arises from the possibility of reaching a relative velocity between liquid and particles during the filtration time higher than the velocity feasible in counterflow treatments of deformable particles. This possibility is due to the method used to carry out the flow in stages and to the arrangement of fixed obstacles, the size and spacing of which are accommodated to the size and deformability of the particles.

The invention has been specially developed to take advantage of a considerable relative velocity of liquid and particles in the treatment of thin and flexible particles such as cellulose fibers, that could not possibly be industrially treated by means of systems with continuous counterflow passages.

This invention is useful to carry out:

a. the washing of cellulose pulp
b. the paper pulp bleaching reactions
c. the cooking or digestion without pressure of wood shavings and particles of annual plants, to obtain cellulose pulp.

Conventionally, the washing of cellulose pulp is undertaken by displacement of its liquid with clean water in a continuous process with the pulp spread in thin layers over the cylinder of a vacuum filter.

Conventionally, the bleaching reactions of paper pulp with the bleaching reagents, are carried out continuously by confluent flow in a vertical retaining tower preceded by an adequate mixer for mixing the pulp and the liquid reagents and followed by a vacuum filter for washing.

Conventionally, the digestion of annual plant particles, is carried out in a continuous confluent process, frequently with the help of screws or propellers for the progression of the mass, and for production of some relative velocity between particles and liquid. These digestions are followed by washing the pulp.

It is known that a counterflow realization of those processes would present great advantages, however, the size and flexibility of the particles has precluded its use either during the whole process or its final part.

The apparatus of this invention essentially consists of a cylindrical vertical tower where particles and liquid are made to circulate in opposite direction in small, successive two-movement stages, consisting of a descent of liquid and particles in mass, and a longer run ascent of the liquid alone (filtration).

The directions of downward movement for the pulp or mass of particles and upward for the liquid, have been adopted for the following reasons:

a. the density of the particles is greater than the density of water
b. the downward movement of the mass of particles permits an easy solution to the problems of introduction and removal of the mass
c. the upward movement of liquors is appropriated to prevent or reduce the escape of the reagents that are used in some of the bleaching reactions, either dissolved or diffused in the liquor of treatment
d. the filtration of liquid in the ascending direction may be easily regulated either by flow or pressure.

The two movements of each stage, mass movement and filtration, are produced by the mechanical actions of external devices upon the liquor and mass of particles and by the effect of the fixed obstacles located inside the tower.

The external devices include: adequate means for the introduction and removal of mass during the mass movements, adequate means for the introduction of water during the filtration periods, and may also include the necessary means of introducing the reagent liquors, preferably during filtration periods.

The fixed obstacles opposing the mass movement include a screen in the upper section of the tower, and a body of grids extended from a section close to the upper screen to a section near the bottom of the tower. The size of the screen pores only permits the passage of the liquor. The body of grids with the same section as the tower is constituted of parallel and equidistant strips. The grids are assembled one upon the other with the strips of two contiguous grids set at right angles. The distance between the parallel strips permits the movement of the mass of particles through the grids.

The extreme compartments of the tower, without grids, are used to receive the mass of particles to be treated in the upper one, and to facilitate the removal of treated mass and the introduction of water in the lower one. These compartments do not have grids in order to allow an adequate distribution of outflows and inflows to occur. For the same purpose, there are one or more propellers in the lower compartment that keep the mass contained in it circulating. These devices may be used in the upper compartment too, when the tower is utilized in digestion. In this case, they will only be active during the downward mass movement.

The descending movements are caused by removal from the lower compartment of an amount of mass that has been fixed to descend in each stage. With these extractions, a downward motion of the mass is generated, with enough velocity to drag the mass of particles along the strips, shearing the mass of particles against the upper edges of the strips. At the same time, the new amount of mass to be treated is introduced through the upper compartment just below the screen.

The ascending movements of liquid are caused by water injections through the lower compartment and, eventually, by the entry of reagent liquors at intermediate sections. During these filtrations, the used liquor flows out of the tower through the screen while the particles remain practically stationary, retained by the screen and by the lower edges of the strips of the different grids.

The washing of the mass during its passage through the tower is effected by displacement and diffusion in the filtration periods, and by diffusion in the periods of downward mass movement. In this way, the entire tower may be considered a washing device.

Using the tower as a reactor, arranging the entry of reagent liquors at an intermediate section, the part of the tower above this section will be a zone of simultaneous reaction and washing, while the part below the indicated section will be a zone of washing after the reaction.

Whenever necessary for the treatment, the tower may be equipped with heating systems or vapor entries as a means to heat the interior mass.

The invention is applied to the treatment of small and deformable particles, because it allows the passage of the phases through the apparatus in opposite directions with the help of fixed obstacles, instead of the mobile devices previously needed to obtain a counterflow passage of the phases. The obstacles, because they are fixed, may be closely arranged in vertical direction, which will provide, depending on the tower's height, a considerable total surface area opposing the movement of the particles, without noticeably reducing the effective cross-sectional area of the tower.

The larger the opposing surface area, the lower the density of the thrust of the liquid upon the particles, and the lower the degree of packing of the particles against the obstacles. It is then possible to get a considerable relative velocity between the liquid and particles without excessive compacting force on the particles.

For all deformable particles it should be possible to establish an expression:

$$V_c = \frac{f(r)}{f(l)}$$

which gives the critical velocity $V_c$ in terms of the rigidity of the particles $r$ and of the thickness of the layer of particles $l$. This critical velocity is the maximum possible without leading to a constriction of the flow and an accompanying reduction in velocity.

For a mass of particles between a grillage, the thickness of the layer $l$ equivalent for same compactness is given by:

$$l = \frac{s}{e} \cdot p$$

where; $s$ is the distance between strips or bars of each grid, $e$ is the width of the edge of the strips, $p$ is the "pitch" of the grillage or distance between contiguous grids.

In order to keep the compactness of the mass against the edges of the strips at a little value and thereby allow for a high liquid velocity through the material it is necessary to limit $l$ according to the deformability of the particles.

With this method, tests were made in 1973 at the Paperleras Arzabalza - Tolosa, Spain, of bleachings of eucalyptus globulus pulps. In a pilot tower of 6 m of height and 2 m of diameter, equipped with a first design of body of grids, relative velocities between particles and liquid of 2–3 m/hour were obtained. These tests were abandoned because this paper factory stopped manufacturing pulp. Later, in the forest section of the "Institute Nacional de Investigaciones Agraries" (National Institute of Agrarian Research), tests were made with new grid designs with which stable filtration velocities of 6m/hour were obtained with pulps of Eucalyptus globulus, pinaster pine, wheat straw, and esparto grass.

Adapting the placement and size of the fixed obstacles to the characteristics of the cellulose pulp fibers, this invention permits velocities of filtration that represent substantial advantages in relation to the conventional methods.

One object of this invention is the washing of cellulose pulp in a thick layer. The washing takes place with the movement in opposite directions of the fibers and washing water, gradually undertaken by stages, with diffusion and diffusion-displacement periods in each of the stages.

Another object is to provide a new tower in which to carry out any of the bleaching and cleaning reactions of cellulose pulp. Conventionally undertaken in static conditions, these reactions may now be carried out with considerable relative velocity between phases which represents substantial savings in time chemical consumption and better yields over the conventional method. At the same time, it will be possible to eliminate the apparatus for premixing and subsequent washing, necessary with conventional towers.

Another object of this invention is to provide a new tower in which to carry out digestion without pressure, to obtain paper pulp, from wood shavings or annual plants such as straw, esparto, and bagasse from sugar cane. In the tower, the digestion may proceed with the movement in opposite directions of the two phases, which offers substantial savings in time, chemical consumption and better yields over the conventional methods by concurrent flow, with small or no relative velocity at all between phases. In addition, it would not be necessary to procure additional washing devices.

BRIEF DESCRIPTION OF THE DRAWINGS

The indicated uses will be better understood with the following explanations that make explicit references to the attached figures representing graphic schemes of the tower. The schemes are of an illustrative nature and must not be taken in a limiting sense.

FIGS. 1 to 8 show a tower designed according to this invention to carry out a bleaching reaction of paper pulp.

FIG. 1 is a vertical section of the tower with indication of a possible distribution of the exterior means necessary for its automatic operation.

FIG. 2 shows a vertical section of the tower rotated 90° with respect to the section in FIG. 1.

FIG. 3 shows horizontal cross-section of the upper compartment and the grid placed immediately below. This is the compartment where the material to be treated is introduced.

FIGS. 4–7 show respectively, the arrangement of the strips in four contiguous grids; this arrangement is repeated in each group of four grids.

FIG. 8 shows a horizontal cross-section of the lower compartment and the exterior means associated with it; this is the compartment of mass extraction and water introduction.

FIG. 9 shows a vertical section of the tower and a tentative arrangement of the exterior means necessary for its automatic operation.

FIG. 10 shows a vertical cross-section rotated 90° in relation with FIG. 9 of the upper zone of the tower.

FIG. 11 shows a horizontal section of the upper compartment of the tower, indicating the placement of the nearest grid.

FIG. 12 shows a grid of the reaction zone of the tower in FIG. 9; the dimensions and distances between strips in this zone vary within the values corresponding to the ones in the grid immediately below the upper compartment and those in the grid of the section where the reagent is introduced.

FIG. 13 shows a scheme of the means for the reagent distribution in an intermediate section of the tower.

FIG. 14 shows the means for horizontal distribution of a vapor, the entrance of which may be situated near the bottom of the tower as in FIG. 9.

FIG. 15 shows a horizontal cross-section of the lower compartment, or the compartment of material removal and water introduction, indicating the exterior means associated with this compartment.

Figures 9, 10, 11, 12, 13, 14, 15:
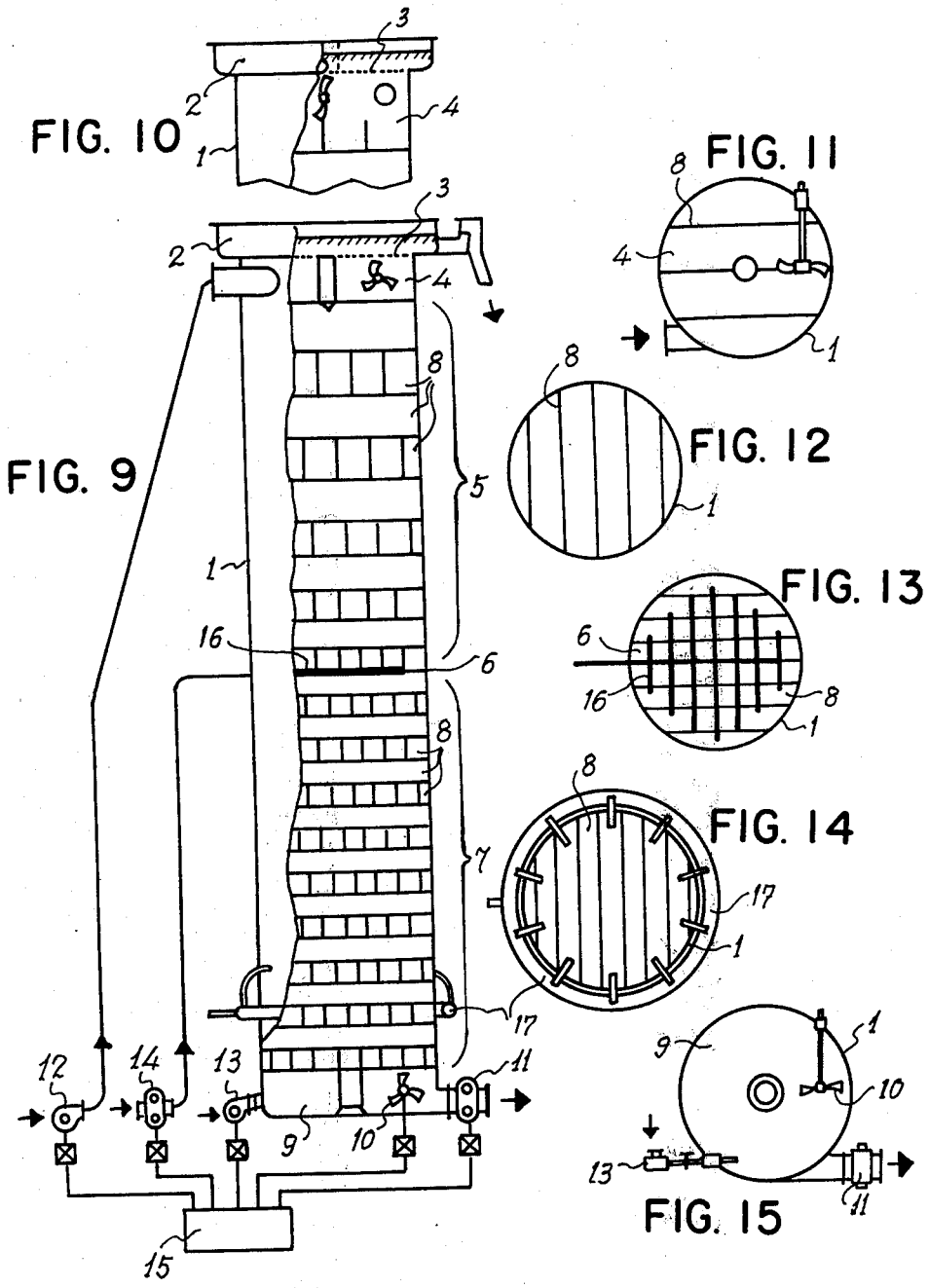
FIGS. 9–15 show a tower designed according to this invention, to carry out the digestion of annual plant particles or wood shavings in a paper pulp making process.

To clarify the schemes, the heights and distances between strips have been represented greater than those which would correspond to the scale of the tower.

FIGS. 16 to 18 show a typical section of a grillage in full scale.

FIG. 16 is a horizontal view showing the spacing and arrangement of four layers of the body of grids.

FIGS. 17 and 18 are vertical cross-sections of the body of grids, one being rotated 90° from the other.

DESCRIPTION OF THE PREFERRED EMBODIMENTS

According to this invention, the device to carry out bleaching reactions of cellulose pulp consists of a vertical tower 1, in FIG. 1, with an open portion of low height 2, in FIGS. 1 and 2. The bottom of the open portion is formed with a screen 3 that limits the cylindrical body of the tower on its upper end. This screen prevents the outflowing of fibers during filtration time and permits the outflowing of the liquor that comes out of the tower through a drain communicating with the open portion that regulates the maximum level of liquid inside the apparatus.

The introduction of the reagent for the treatment is done by adequate exterior means 14, connected to a distribution means 16 arranged in the middle section of the tower 6. This section separates the inside of the tower into two zones: the upper zone or reaction zone 5 and the bottom zone or zone of after-washing 7.

The reaction zone 5 has a small compartment, free of grids, immediately below the screen. This upper compartment 4, FIGS. 1, 2 and 3, is the place where the pulp is introduced. For this purpose, it has a port in the wall connected to an adequate exterior device 12.

The washing zone 7 has a small compartment free of grids 9, located at the bottom of the tower. This compartment, in FIGS. 1 and 8, is the place where the treated pulp is removed and the water is introduced. For this purpose, it is connected through a port to adequate exterior devices 11, 13, in FIGS. 1 and 8. The height of this compartment is sufficient to permit the arrangement of one or more propellers 10 which will produce a homogeneous distribution of the pulp during material outflows and water inflows.

The grids to hold and shear the pulp 8, in FIGS. 1 and 4, fill the interior of the tower, excluding the extreme compartments. These grids are made up of thin strips, which may have the upper edges sharpened to facilitate the cutting of the pulp. The strips in a grid are parallel, equidistant and mounted with their longest axis perpendicular to the strips of the contiguous grid.

The grids of the present invention function to divide the tower into several sections, as could be done by a series of screens, in that the material is distributed in several thin layers throughout the height of the tower during the upward movement of the water. Unlike screens, however, the grids allow for the passage of the material in a downward direction. In a typical body of grids arrangement, as shown in FIGS. 16–18 having strips 5mm in width, spaced 30cm horizontally and 20mm vertically, one sixth of the cross-sectional area of the tower will be blocked by a single grid, resulting: $l =$ 120 mm.

Using the above-described body of grids with a pertinent mass concentration (about 3.5%), it will be possible to obtain a relative velocity between liquid and particles (the velocity of filtration) of up to 4 or 5 m/hour, when the liquid is flowing up through the tower. The liquid and particles are made to flow downward at higher velocities (higher than 10 m/hour) to cause the mass to be cut as fluid on the sharpened upper edges of the grid strips (see FIGS. 17,18).

In order to obtain a net upward flow of the liquid, it will be necessary to make the slower, upward displacements of longer duration than the faster, downward displacements.

The tower to be used in the digestion of vegetal particles, as in FIG. 9, is based on the same principles. However, it differs from the one represented in FIG. 1, because some specific features have been incorporated to accommodate it to the different characteristics of the particles and to obtain a temperature of about 100° C (212° F), during the treatment. The elements of this digestor, similar to those of the bleaching tower, are indicated in FIGS. 6 to 12 using the same reference numbers of FIG. 1.

In this digestion tower, the height of the upper compartment, or the compartment 4 where the particles are introduced, the heights and distances between strips of the upper grids in the reaction zone 5, are greater than those corresponding to the bleaching tower. This is to adapt the apparatus to the smaller deformability and larger size of the particles. Through the reaction zone 5, the heights and distances between strips decrease gradually from those in the upper compartment 4, to those in the section of distribution of reactive 6, in FIGS. 9 to 13, to adapt them to the increase in deformability and decrease in size of the particles, which occur as the particles travel through the reaction zone. The grids in the washing zone 7 may be designed with strips at the same distance and with the same height, because no noticeable change in the particles occurs in this zone.

With this tower, a system has been set up to heat the rising liquor to a temperature near 100° C., in order to carry out digestion and washing to a relatively high temperature, especially at the intermediate zone of the tower. A heating system is indicated in FIGS. 9 and 14, with vapor entrances through a pipe 17, but the heating may be accomplished by any suitable means.

In both towers, FIGS. 1 and 6, a control panel 15 has been schematically indicated from which to regulate the operating cycle of each one of the exterior devices 11, 12, 13, and 14, effecting the introduction and removal of particles, and the introduction of liquors.

With the tower filled with the mass of particles at working consistency, the level of liquid above the screen 3, FIGS. 1 and 9, and the propeller 10 agitating the mass in the lower compartment, the period of mass movement in each stage begins with the start of the pumps 11 and 12, the volumetric pump 11 which removes, by suction, the already treated mass from the bottom of the tower for sending it to a following process and the pump 12 that introduces into the tower the new mass to be treated, from an adequate previous deposit and through the entrance located in the upper compartment 4. In case of a pulp washing or bleaching process, as in FIG. 1, the mass introduction pump 12 may be a volumetric pump, similar to the mass extraction pump 11, the working consistency of the mass being regulated in that entrance of the previous deposit. In the case of a tower for the digestion of vegetal particles, as in FIG. 9, the mass introduction pump 12 may be a centrifugal pump and the working consistency would then be regulated by the feeding pressure. The amount of mass extracted in each stage may be regulated by the timing of the extraction pump 11. The period of mass movement at each stage is ended by the stopping of the mass introduction pump 12, regulated at same time in the first case, FIG. 1, or by pressure in the second case, FIG. 9.

Following the period of mass movement, the filtration period in each stage begins with the starting of the water introduction pump 13. The rotation of the mass in the lower compartment and the arrangement of the strips in the tower will provide an even distribution of the water through the tower, thus causing only small local movements of the particles, without creating excessive compression near the screen or the lower edge of the strips, because of the relatively great opposing surface area of the lower edges of the strips. A determined volume of residual liquor will, in each stage, pass through the screen 3, flowing regulated by the working time of the pump for introducing water 13 or by the volume introduced by it. Once the adequate volume is reached, the filtration period ends with the stopping of the pump 13. A new stage will begin with the starting of the mass extraction and introduction pumps 11 and 12, respectively.

The downward movement of the material in each stage is adjusted so that a sufficient number of stages (8 or more) are required to move a given piece of material through each zone (the reaction zone and the washing zone).

The pump to dose the reagent 14 may be working during the whole stage or only part of it. In the tower represented in FIG. 1, with the alternating functioning of the pumps 11 and 12 on the one hand and of the pump 13 on the other, as has been just mentioned, it will be possible to carry out bleaching reactions. These reactions might be undertaken at adequate temperatures caused by the necessary means to heat the interior mass.

Similarly, in the tower represented in FIG. 9, having a heating system to heat the ascending liquor up to 100° C, and with the alternating functioning of the pumps 11 and 12 on the one hand and of the pump 13 on the other, as has been previously mentioned, it will be possible to carry out the digestion of vegetal particles to obtain cellulose pulp.

In both cases, it will be possible to carry out the treatment automatically, controlling, with a control panel 15, the automatic sequencing of the different pumps.

Automatic control will be necessary since the stages are of short duration (4–8 minutes), and a considerable precision is required to assure uniform treatment of the material.

If the different zones of the towers represented in FIGS. 1 and 9 are given sufficient height, if the concentration of reagent and the regulation of liquid flows and temperature are adequate, the particles will come out of the tower properly treated and washed.

With an arrangement of a series of various bleaching towers, each similar to the tower depicted in FIG. 1, it will be possible to carry out a sequential process similar to the bleaching treatments in various steps. In the connection of the towers, the extraction pump 11 of a tower will work as an introduction pump for the next one. In this sequential process, external washing and mixing devices will not be necessary.

In some treatments, towers designed according to this invention, having various inlets at intermediate heights for carrying out step-like processes with different reagents may be used. The present invention may also be used for treatment which involve dissolutions in non-neutral means, but which include final washing with water.

A tower of the type represented in FIG. 1, without necessity of the inlets at intermediate heights, constitutes an automatic washing device, with the process carried out in multiple and successive stages, and with the passage of the liquid in a direction opposite to the passage of the solid.

What is claimed is:

1. A device for the counterflow treatment in stages of fibrous deformable particles with liquid comprising:

a vertical tower formed by a cylindrical wall and having an upper chamber, a lower chamber, and a longer middle section between and contiguous with said chambers;

a filtering screen extending across the top of said tower, for the purpose of blocking the flow of said particles, while allowing the flow of said liquid out of said upper chamber;

a shallow vertical open portion atop said tower, for containing said liquid which flows through said screen, said open portion including a drain for limiting the maximum level of the liquid;

a particle inlet located in the upper chamber;

a particle introducing means, exterior to said tower, for causing the flow of said particles in a mass into said upper chamber through said particle inlet;

a body of grids extending through said middle section, made up of a series of contiguous horizontal grid layers having the same cross-sectional area as the interior of said tower, each of said horizontal grid layers being made up of parallel equidistant strips, the ends of which are contiguous with the inner surface of said tower, said strips being spaced to permit the movement of said mass through said body of grids, said grid layers being stacked one upon the other in such a way that said strips of each of said layers are perpendicular to the strips of each contiguous grid layer;

a material outlet in said lower chamber, being tangential to said wall of said tower;

a mass removing means, exterior to said tower, to cause said mass to flow out of said tower through said material outlet;

a liquid inlet in said lower chamber;

a liquid introducing means, exterior to said tower, to cause said liquid to flow into said tower through said liquid inlet, at least one propeller in said lower compartment for stirring said mass; and an automatic control means, exterior to said tower, for automatically controlling said liquid introducing means, said mass removing means, and said particle introducing means, for operation in a predetermined sequence, said sequence consisting of a downward mass movement caused by the action of said mass removing means and said particle introducing means, followed by an upward liquid movement caused by the action of said liquid introducing means, said body of grids functioning to distribute and oppose the thrust exerted on said particles by said liquid during its upward movement, thereby reducing the compression of the particles against said screen and said grids and allowing an increase in the relative velocity between said particles and said liquid.

2. The device as claimed in claim 1, further comprising a heating means to heat said mass in said tower.

3. The device as claimed in claim 1, further comprising:

a reagent distributing means located in said middle section midway between said upper chamber and said lower chamber; and a reagent introducing means, exterior to said tower, for causing a chemical reagent to flow into said tower through said reagent distributing means, said reagent introducing means being controlled by said automatic control means.

4. The device as claimed in claim 3, further comprising:

at least one additional propeller in said upper chamber for stirring said particles; and wherein the thickness, height, and spacing of said strips making up said body of grids decrease from top to bottom, between said upper chamber and said reagent distributing means.

5. The device as claimed in claim 1, wherein said strips making up said grid layers are of an upright rectangular cross-section with a knife-edge upper profile.

* * * * *